US011459912B2

(12) United States Patent
Nakayama et al.

(10) Patent No.: US 11,459,912 B2
(45) Date of Patent: Oct. 4, 2022

(54) FLOW GUIDE, STEAM TURBINE, INSIDE MEMBER, AND METHOD FOR MANUFACTURING FLOW GUIDE

(71) Applicant: Mitsubishi Power, Ltd., Yokohama (JP)

(72) Inventors: Takeki Nakayama, Yokohama (JP); Yasuyuki Tatsumi, Yokohama (JP); Takeo Tokumoto, Yokohama (JP); Hiromu Sagimori, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/973,511

(22) PCT Filed: Jul. 8, 2019

(86) PCT No.: PCT/JP2019/026939

§ 371 (c)(1),
(2) Date: Dec. 9, 2020

(87) PCT Pub. No.: WO2020/013109

PCT Pub. Date: Jan. 16, 2020

(65) Prior Publication Data

US 2021/0239014 A1 Aug. 5, 2021

(30) Foreign Application Priority Data

Jul. 13, 2018 (JP) ..... JP2018-133119

(51) Int. Cl.
*F01D 25/24* (2006.01)
*F01D 9/02* (2006.01)

(52) U.S. Cl.
CPC ..... *F01D 25/24* (2013.01); *F01D 9/02* (2013.01); *F05D 2220/31* (2013.01); *F05D 2230/60* (2013.01)

(58) Field of Classification Search
CPC ..... F01D 11/08; F01D 11/12; F01D 11/122; F01D 11/16; F01D 25/24; F01D 25/30; F01D 25/243
See application file for complete search history.

(56) References Cited

U.S. PATENT DOCUMENTS

2011/0280712 A1 11/2011 Graefe et al.
2013/0189077 A1* 7/2013 Tsukuda ..... F01D 5/14 415/92

(Continued)

FOREIGN PATENT DOCUMENTS

JP S59-071902 U 5/1984
JP S60-184904 A 9/1985

(Continued)

OTHER PUBLICATIONS

International Search Report dated Sep. 17, 2019, issued in counterpart Application No. PCT/JP2019/026939, with English Translation. (4 pages).

(Continued)

*Primary Examiner* — Woody A Lee, Jr.
*Assistant Examiner* — Cameron A Corday
(74) *Attorney, Agent, or Firm* — WHDA, LLP

(57) ABSTRACT

A flow guide is provided with a flange, a guide plate, and an inside member. A ring groove which is recessed to the radially outer side from an inner circumferential surface and which extends in a circumferential direction based on the axis is formed in the flange. The inside member includes a fitted portion which enters the ring groove, and a cover portion which faces the inner circumferential surface of the flange in the radial direction. The cover portion covers at least parts of the inner circumferential surface of the flange and an inner circumferential surface of the guide plate that face a tip end of a moving blade in the radial direction. The cover portion is formed from a material having a higher (Continued)

erosion resistance with respect to steam and steam drain than the flange.

14 Claims, 4 Drawing Sheets

(56) References Cited

U.S. PATENT DOCUMENTS

| | | | | |
|---|---|---|---|---|
| 2015/0176435 | A1 | 6/2015 | Nagao et al. | |
| 2021/0285339 | A1* | 9/2021 | Kawano | F01D 9/04 |

FOREIGN PATENT DOCUMENTS

| | | | |
|---|---|---|---|
| JP | H06-129206 | A | 5/1994 |
| JP | 2002-206405 | A | 7/2002 |
| JP | 2005-002917 | A | 1/2005 |
| JP | 2015-098789 | A | 5/2015 |
| JP | 2016-084861 | A | 5/2016 |
| JP | 6000354 | B2 | 9/2016 |
| JP | 2017-172382 | A | 9/2017 |
| JP | 2018-168844 | A | 11/2018 |

OTHER PUBLICATIONS

Written Opinion dated Sep. 17, 2019, issued in counterpart Application No. PCT/JP2019/026939, with English Translation. (21 pages).

* cited by examiner

FLOW GUIDE, STEAM TURBINE, INSIDE MEMBER, AND METHOD FOR MANUFACTURING FLOW GUIDE

TECHNICAL FIELD

The present invention relates to a flow guide, a steam turbine, an inside member, and a method for manufacturing a flow guide.

Priority is claimed on Japanese Patent Application No. 2018-133119, filed Jul. 13, 2018, the content of which is incorporated herein by reference.

BACKGROUND ART

A tip portion of a last stage rotor blade of a steam turbine is easily eroded by steam drain.

PTL 1 discloses a technology in which a drain discharging hole is formed to be closer to an axial downstream side than a leading edge of a rotor blade at a last stage such that steam drain can be sufficiently discharged and erosion can be reliably prevented. In the rotor blade at the last stage of PTL 1, a weld overlay or a seal plate is attached to the leading edge portion or the tip portion of the suction side of the blade to prevent erosion.

CITATION LIST

Patent Literature

[PTL 1] Japanese Unexamined Patent Application Publication No. 60-184904

SUMMARY OF INVENTION

Technical Problem

In the steam turbine described in PTL 1, there is a case where a part of a segment holder (hereinafter, referred to as a flange) on the axial downstream side causes erosion to progress due to the steam drain. When the erosion of the flange progresses and reaches an attaching part of a radial strip (hereinafter, referred to as a seal ring), there is a possibility that the seal ring falls off the flange. Therefore, in the steam turbine described in PTL 1, it is necessary to shorten the repair interval of the flange.

An object of the present invention is to provide a flow guide, a steam turbine, an inside member, and a method for manufacturing a flow guide that can lengthen the repair interval while suppressing manufacturing costs and repair costs.

Solution to Problem

According to a first aspect of the present invention, a flow guide includes a flange, a guide plate, and an inside member. The flange is disposed on a radial outer side based on an axis with respect to a last stage rotor blade row of a steam turbine rotor that rotates about the axis. The guide plate forms an annular shape based on the axis, and gradually widens to the radial outer side as going toward an axial downstream side which is a first side in an axial direction in which the axis extends. The guide plate is disposed on the axial downstream side which is the first side in the axial direction in which the axis extends, with respect to the flange. The inside member is attached so as to cover an inner peripheral surface of the flange. A ring groove which is recessed to the radial outer side from the inner peripheral surface of the flange and extends in a circumferential direction based on the axis is formed in the flange. The inside member includes a fitted section, a cover section, and a fin. The fitted section enters the ring groove. The cover section faces the inner peripheral surface of the flange in a radial direction. The fin extends toward the radial inner side based on the axis from the cover section. The cover section covers at least parts of the inner peripheral surface of the flange and an inner peripheral surface of the guide plate, which face a rotor blade tip of the last stage rotor blade row in the radial direction. The cover section is formed of a material having a higher erosion resistance with respect to steam and steam drain than that of the flange.

In the first aspect, the cover section of the inside member is disposed so as to face the inner peripheral surface of the flange in the radial direction, and covers at least the parts of the inner peripheral surface of the flange and the inner peripheral surface of the guide plate, which face the rotor blade tip of the last stage rotor blade row in the radial direction. The cover section is further formed of a material having a higher erosion resistance than that of the flange. Therefore, the fin of the inside member can reduce the leakage of the flow that flows between the flange and the tip of the rotor blade, and the cover section of the inside member can suppress contact of the steam drain with the flange. Therefore, compared to a case where the flange itself is formed of a material having a higher erosion resistance, it is possible to suppress the manufacturing costs and repair costs of the flow guide, and to lengthen the repair interval while suppressing erosion of the flange.

According to a second aspect of the invention, the cover section according to the first aspect may face an inner peripheral surface upstream side portion which is a part on an axial upstream side of the inner peripheral surface on the guide plate in the radial direction, and also cover the inner peripheral surface upstream side portion.

With this configuration, since the cover section can be installed so as to extend over the inner peripheral surface of the flange and the inner peripheral surface of the guide plate, it is possible to suppress the erosion of the connecting part between the flange and the guide plate and the inner peripheral surface upstream side portion of the guide plate, respectively.

According to a third aspect of the invention, the flow guide according to the second aspect may further include a welded portion that joins the flange and the guide plate.

With this configuration, the welded portion can be covered from the radial inner side by the cover section. Therefore, it is possible to suppress the erosion of the welded portion.

According to a fourth aspect of the invention, the guide plate according to the second aspect or the third aspect may have an enlarged diameter portion. The enlarged diameter portion is formed to be closer to the axial downstream side than the inner peripheral surface upstream side portion, and an inner diameter gradually increases as going toward the axial downstream side. The inner peripheral surface upstream side portion of the guide plate has a constant inner diameter at any position in the axial direction. The cover section may have an inclined surface that gradually extends to the radial outer side as going toward the axial downstream side. The inclined surface may gradually extend to a downstream side end surface which is an end surface of the cover section on the axial downstream side. The inclined surface may have an extension line of a tangent line within a virtual plane including the axis, which is at a position on the most axial upstream side in an inner peripheral surface of the enlarged diameter portion.

As described above, the inclined surface includes the extension line of the tangent line within the virtual plane including the axis at the position on the most axial upstream side of the enlarged diameter portion, and accordingly, it is possible to suppress occurrence of delamination on the axial downstream side of the rotor blade in the last stage, and to smoothly recover the pressure of the main flow toward the axial downstream side from the edge on the axial upstream side of the inclined surface.

According to a fifth aspect of the invention, the flow guide according to the fourth aspect may further include an elastic body that is disposed in the ring groove and pushes the inside member to the radial inner side. The fitted section may have a radial positioning surface that faces a radial inner side. The ring groove may have a stopper surface that faces the radial outer side and is in contact with the radial positioning surface. When the radial positioning surface and the stopper surface are in contact with each other, the inclined surface may include the extension line of the tangent line.

By providing the elastic body that pushes the inside member to the radial inner side, for example, in a case where the tip of the rotor blade comes into contact with the fin and the force for pushing the inside member of the elastic body to the radial inner side is exceeded, it is possible to displace the inside member to the radial outer side. The fitted section of the inside member has the radial positioning surface that faces the radial inner side and the ring groove has the stopper surface that faces the radial outer side and is in contact with the radial positioning surface, and accordingly, it is possible to displace the inside member to the radial outer side, and to position the inside member. Furthermore, when the radial positioning surface and the stopper surface are in contact with each other, the inclined surface includes the extension line of the tangent line on the axial upstream side of the guide plate, and accordingly, when the steam turbine is in the stable operation, it is possible to smoothly recover the pressure of the main flow toward the axial downstream side from the edge on the axial upstream side of the inclined surface.

According to a sixth aspect of the invention, the inside member according to any one of the first to fifth aspects may include a fin that extends toward the radial inner side from an inner peripheral surface of the cover section that faces the rotor blade tip.

By providing the fin, it is possible to suppress leakage of steam from between the flange and the last stage rotor blade row.

According to a seventh aspect of the invention, a steam turbine includes the flow guide according to any one of the first to sixth aspects, the steam turbine rotor, and a casing. The casing has a cylindrical shape about the axis, and the steam turbine rotor is disposed on a radial inner side. The flow guide is attached to the casing.

With this configuration, since it is possible to lengthen the interval for repairing the flow guide, the burden on the operator who repairs the steam turbine can be reduced.

According to an eighth aspect of the invention, a method for manufacturing a flow guide includes a preparation step and an assembly step. In the preparation step, the flange, the guide plate, and the inside member are prepared. In the assembly step, a fitted section of the inside member is put into the ring groove of the flange.

By doing so, the flange and the inside member can be easily molded from different materials in the preparation step. Furthermore, in the assembly step, the fitted section of the inside member can be put into the groove of the flange prepared in the preparation step. Therefore, it is possible to easily manufacture the flow guide. Even when the erosion of the inside member progresses and the inside member is replaced, the inside member can be attached to the flange by simply preparing the inside member and putting the fitted section into the groove of the flange.

According to a ninth aspect of the invention, the fin according to the sixth aspect may be disposed to be closer to the axial upstream side than a center position in an axial direction between an end surface on the axial upstream side of the cover section and an end surface on the axial downstream side of the cover section.

According to a tenth aspect of the invention, the fin according to the sixth or ninth aspect may extend toward a radial inner side from the cover section and may be integrally formed with the cover section.

According to an eleventh aspect of the invention, the fitted section according to any one of the first to fifth, ninth, and tenth aspects may include a first fitted section and a second fitted section. The second fitted section is positioned on the radial outer side of the first fitted section, and has a width dimension wider than that of the first fitted section. Of gaps formed between the first fitted section and the ring groove, a gap formed on the axial downstream side may be narrower than a gap formed on the axial upstream side.

According to a twelfth aspect of the invention, the inside member is attached so as to cover an inner peripheral surface of a flange disposed on a radial outer side based on an axis with respect to a last stage rotor blade row of a steam turbine rotor that rotates about the axis. The inside member includes a fitted section, a cover section, and a fin. The fitted section enters a ring groove of the flange. The cover section faces the inner peripheral surface of the flange in a radial direction. The fin extends toward an inner side in the radial direction from an inner peripheral surface of the cover section facing a rotor blade tip of the last stage rotor blade row, on the inner peripheral surface of the cover section. The cover section is formed so as to cover at least parts of the inner peripheral surface of the flange and an inner peripheral surface of the guide plate disposed on an axial downstream side with respect to the flange, which face the rotor blade tip of the last stage rotor blade row in the radial direction. The fin is disposed to be closer to an upstream side than a center position in an axial direction between an end surface on an axial upstream side of the cover section and an end surface on the axial downstream side of the cover section.

According to a thirteenth aspect of the invention, the cover section according to the twelfth aspect may have an inclined surface that gradually extends to the radial outer side as going toward the axial downstream side.

According to a fourteenth aspect of the invention, the fin according to the twelfth or thirteenth aspect may extend toward a radial inner side from the cover section and may be integrally formed with the cover section.

According to a fifteenth aspect of the invention, the inside member according to any one of the twelfth to fourteenth aspects may be provided with a curved surface that is convex toward an outer side between the inner peripheral surface of the cover section and the end surface on the axial upstream side.

According to a sixteenth aspect of the invention, the cover section according to any one of the twelfth to fifteenth aspects may be formed of a material having a higher erosion resistance with respect to steam and steam drain than that of the flange.

Advantageous Effects of Invention

According to the flow guide, the steam turbine, the inside member, and the method of forming a flow guide, it is possible to lengthen the repair interval while suppressing the manufacturing costs and the repair costs.

DESCRIPTION OF EMBODIMENTS

Hereinafter, a flow guide, a steam turbine, and a method for manufacturing a flow guide according to an embodiment of the invention will be described based on the drawings.

First Embodiment

Figure 1:
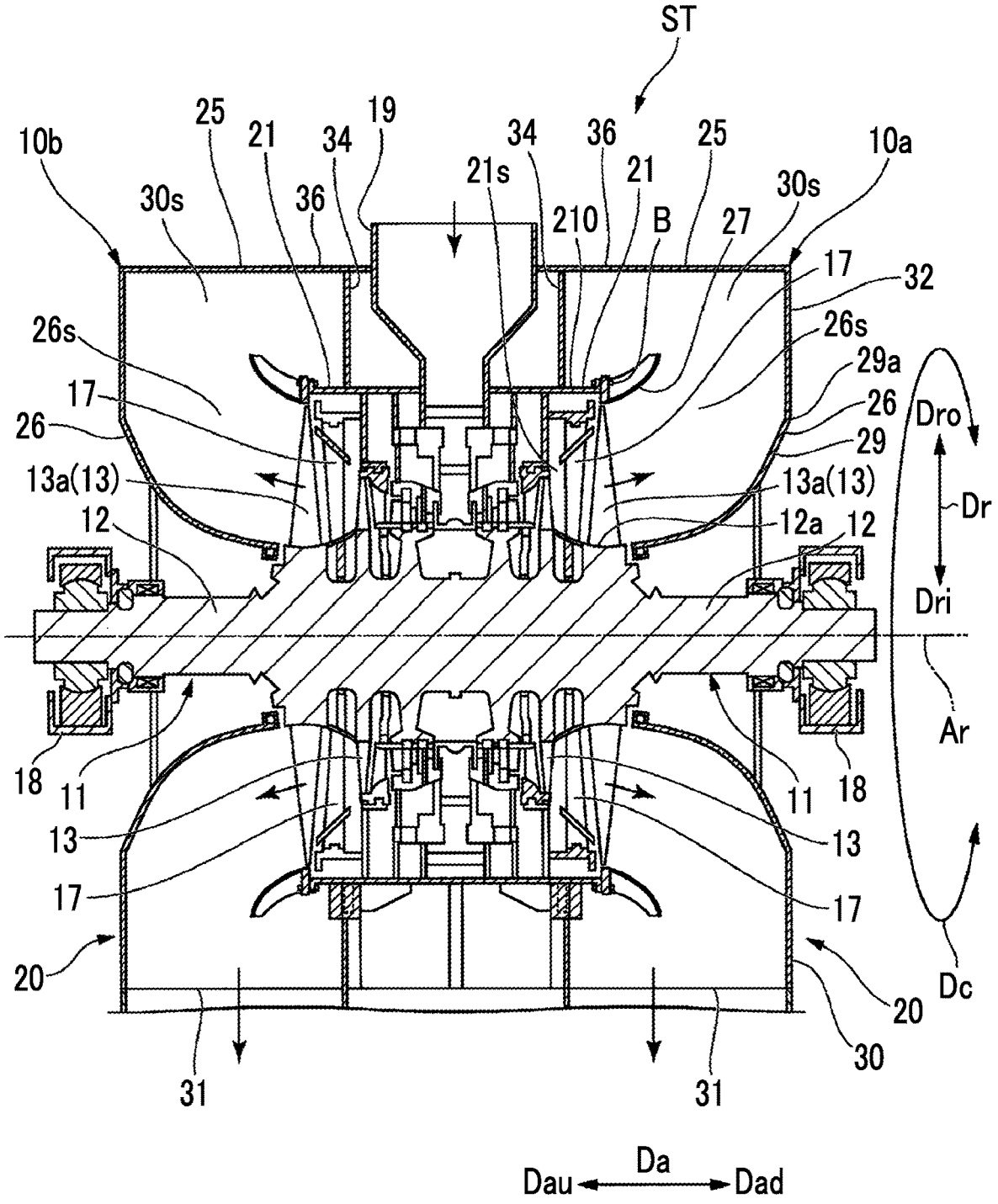
FIG. 1 is a sectional view illustrating a schematic configuration of a steam turbine according to a first embodiment of the invention.

FIG. 1 is a sectional view illustrating a schematic configuration of a steam turbine according to a first embodiment of the invention.

As illustrated in FIG. 1, a steam turbine ST of the first embodiment is a two-way exhaust type steam turbine. The steam turbine ST includes a first steam turbine section 10*a* and a second steam turbine section 10*b*. Each of the first steam turbine section 10*a* and the second steam turbine section 10*b* has a turbine rotor (steam turbine rotor) 11 that rotates about an axis Ar, a casing 20 that covers the turbine rotor 11, a plurality of stator blade rows 17 fixed to the casing 20, and a steam inlet duct 19. In the following description, a circumferential direction about the axis Ar is simply referred to as a circumferential direction Dc, and a direction perpendicular to the axis Ar is referred to as a radial direction Dr. Furthermore, a side from the axis Ar in the radial direction Dr is defined as a radial inner side Dri, and a side opposite thereto is defined as a radial outer side Dro.

The first steam turbine section 10*a* and the second steam turbine section 10*b* share the steam inlet duct 19. Except for the steam inlet duct 19, the first steam turbine section 10*a* is disposed on one side in the axial direction Da based on the steam inlet duct 19. Except for the steam inlet duct 19, the second steam turbine section 10*b* is disposed on the other side in the axial direction Da based on the steam inlet duct 19. Here, the configuration of the first steam turbine section 10*a* and the configuration of the second steam turbine section 10*b* are basically the same. Therefore, in the following description, the first steam turbine section 10*a* will be mainly described, and the description of the second steam turbine section 10*b* will be omitted. In the first steam turbine section 10*a*, the side of the steam inlet duct 19 in the axial direction Da is defined as an axial upstream side Dau, and a side opposite thereto is defined as an axial downstream side Dad.

The turbine rotor 11 has a rotor shaft 12 extending in the axial direction Da about the axis Ar, and a plurality of rotor blade rows 13 attached to the rotor shaft 12. The turbine rotor 11 is supported by a bearing 18 to be rotatable about the axis Ar. The plurality of rotor blade rows 13 are arranged in the axial direction Da. Each of the plurality of rotor blade rows 13 is configured with a plurality of rotor blades arranged in the circumferential direction Dc. The turbine rotor 11 of the first steam turbine section 10*a* and the turbine rotor 11 of the second steam turbine section 10*b* are positioned on the same axis Ar and connected to each other, and rotate integrally about the axis Ar.

The casing 20 has an inner casing 21 and an exhaust casing 25.

The inner casing 21 forms a first space 21*s* that forms an annular shape about the axis Ar, between the rotor shaft 12 and the inner casing 21. The steam (fluid) flowing from the steam inlet duct 19 flows through the first space 21*s* in the axial direction Da (more specifically, toward the axial downstream side Dad). The plurality of rotor blade rows 13 of the turbine rotor 11 are arranged in the first space 21*s*. The plurality of stator blade rows 17 are arranged in the first space 21*s* along the axial direction Da. Each of the plurality of stator blade rows 17 is arranged on the axial upstream side Dau of any one rotor blade row 13 among the plurality of rotor blade rows 13. The plurality of stator blade rows 17 are fixed to the inner casing 21.

The exhaust casing 25 has a diffuser 26 and an outer casing 30.

The outer casing 30 surrounds the turbine rotor 11 and the inner casing 21, and forms a second space 30*s*, to which the steam flowing through the first space 21*s* is discharged, between the inner casing 21 and the outer casing 30. The second space 30*s* communicates with the diffuser 26 and widens on the outer peripheral side of the diffuser 26 in the circumferential direction Dc. The outer casing 30 guides the steam flowing from a diffuser space 26*s* into the second space 30*s*, to the exhaust port 31.

The outer casing 30 has an exhaust port 31 on a first side (lower side in FIG. 1) in a direction orthogonal to the axis Ar. The outer casing 30 exemplified in the embodiment is open vertically downward. The steam turbine ST of the embodiment is a so-called downward exhaust type condensing steam turbine, and a condenser (not illustrated) for returning steam to water is connected to the exhaust port 31. The outer casing 30 in the embodiment includes a downstream end plate 32, an upstream end plate 34, and a side peripheral plate 36, respectively.

The downstream end plate 32 widens from the edge of the bearing cone 29 on the radial outer side Dro to the radial outer side Dro, and defines the edge of the second space 30*s* on the axial downstream side Dad.

The upstream end plate 34 is disposed to be closer to the axial upstream side Dau than the diffuser 26. The upstream end plate 34 widens from an outer peripheral surface 210 of the inner casing 21 to the radial outer side Dro, and defines the edge of the second space 30*s* on the axial upstream side Dau.

The side peripheral plate 36 is connected to the downstream end plate 32 and the upstream end plate 34, widens in the axial direction Da and widens in the circumferential direction Dc about the axis Ar, and defines the edge of the second space 30*s* on the radial outer side Dro.

The diffuser 26 is disposed on the axial downstream side Dad of the inner casing 21, and allows the first space 21*s* and the second space 30*s* to communicate with each other. The diffuser 26 forms the annular diffuser space 26*s* that gradually extends to the radial outer side as going toward the axial downstream side Dad. The steam flowing out from a last stage rotor blade row 13*a* of the turbine rotor 11 toward the axial downstream side Dad flows into the diffuser space 26*s*. Here, the last stage rotor blade row 13*a* is a rotor blade row 13 disposed on the most axial downstream side Dad among a plurality of rotor blade rows 13 included in the first steam turbine section 10*a*.

The diffuser 26 includes a flow guide (also referred to as a steam guide or an outer diffuser) 27 that defines the edge of the diffuser space 26*s* on the radial outer side Dro, and a bearing cone (or referred to as an inner diffuser) 29 that defines the edge of the diffuser space 26*s* on the radial inner side Dri.

The bearing cone 29 is formed in a cylindrical shape extending to the axial downstream side Dad to be continuous with an outer peripheral surface 12*a* of the rotor shaft 12 that forms the first space 21*s*. The bearing cone 29 has a ring-shaped cross section perpendicular to the axis Ar, and the diameter thereof gradually widens toward the radial outer side Dro as going toward the axial downstream side Dad. An end edge 29*a* of the bearing cone 29 is connected to the downstream end plate 32 of the outer casing 30.

The flow guide 27 has a cylindrical shape extending toward the axial downstream side Dad from the end edge of the inner casing 21 on the axial downstream side Dad. The flow guide 27 has a ring-shaped cross section perpendicular to the axis Ar, and the diameter thereof gradually widens as going toward the axial downstream side Dad. The flow guide 27 in the embodiment is connected to the inner casing 21.

Figure 2:
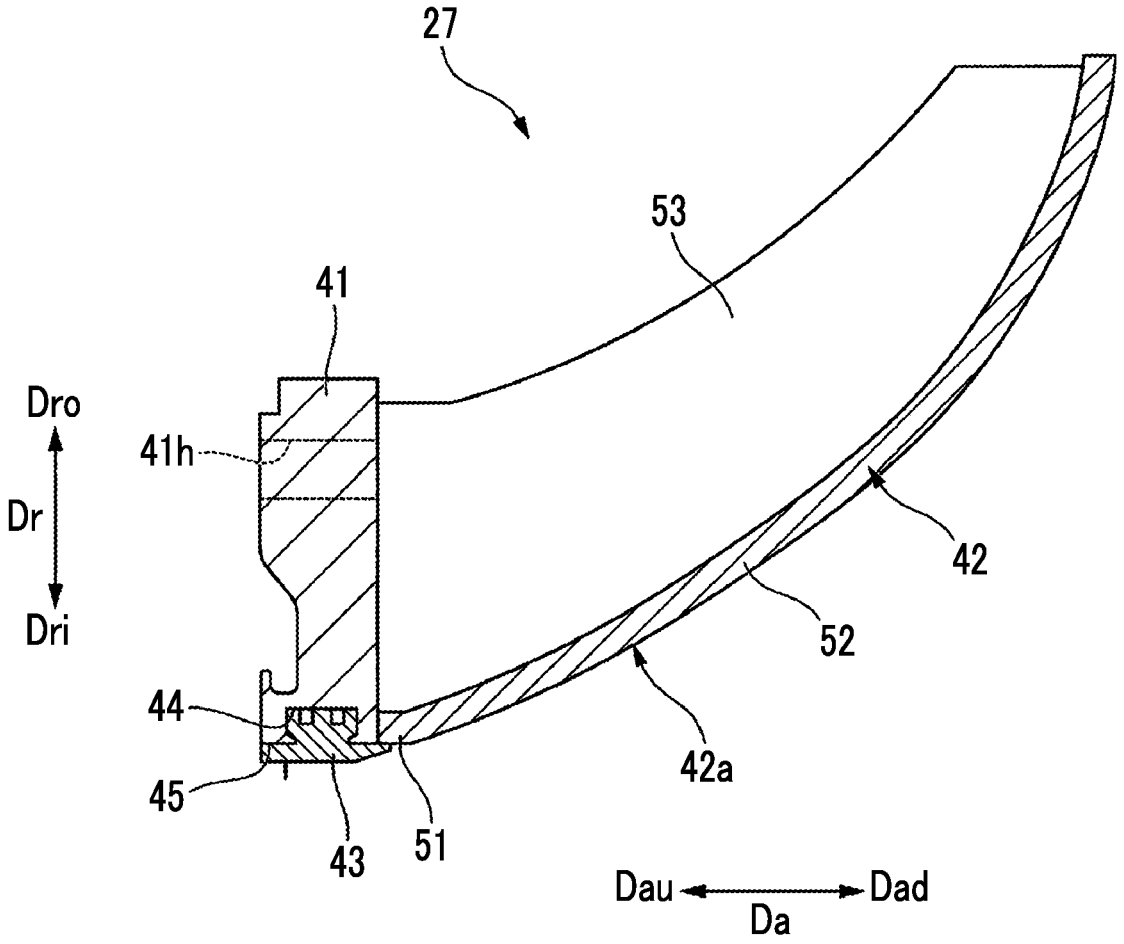
FIG. 2 is a sectional view in which a flow guide according to the first embodiment of the invention is enlarged.
Figure 3:
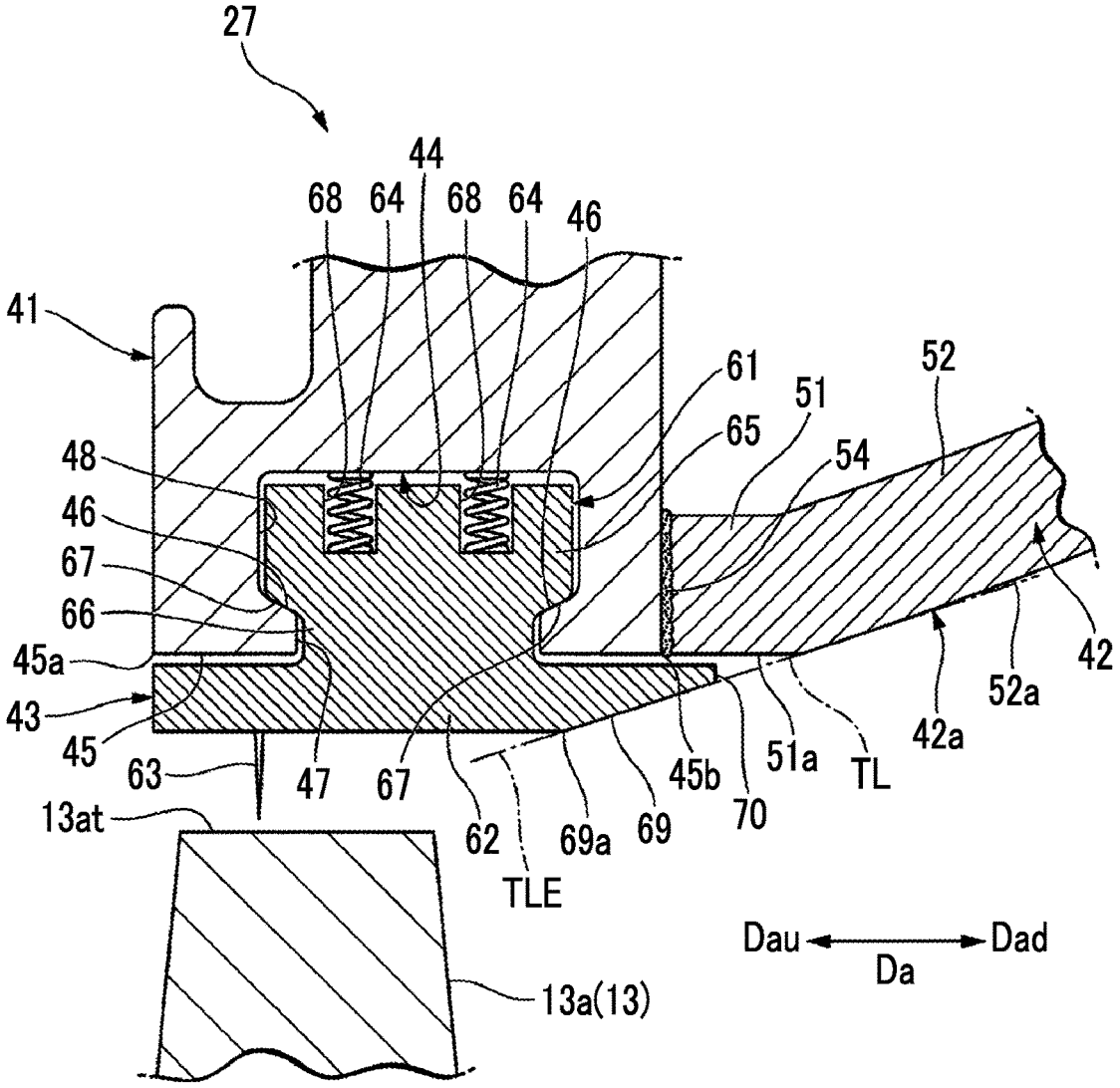
FIG. 3 is a sectional view in which a seal ring according to the first embodiment of the invention is enlarged.

FIG. 2 is a sectional view in which the flow guide according to the first embodiment of the invention is enlarged. FIG. 3 is a sectional view in which a seal ring according to the first embodiment of the invention is enlarged.

As illustrated in FIG. 2, the flow guide 27 includes a flange 41, a guide plate 42, and an inside member 43.

The flange 41 is disposed on the radial outer side Dro with respect to the last stage rotor blade row 13*a* of the turbine rotor 11 that rotates about the axis Ar. The plurality of flanges 41 are arranged in the circumferential direction about the axis Ar to form an annular shape. The flange 41 is formed to be longer in the radial direction Dr than that in the axial direction Da. The flange 41 has a plurality of through-holes 41*h* that penetrate in the axial direction Da at intervals in the circumferential direction Dc. The flange 41 is fixed to the end portion of the inner casing 21 on the axial downstream side Dad by inserting fasteners B such as bolts (refer to FIG. 1) into the through-holes 41*h*.

The flange 41 is formed of a metal material such as carbon steel. A ring groove 44 is formed in the flange 41. The ring groove 44 is recessed on the radial outer side Dro from an inner peripheral surface 45 of the flange 41 and extends in the circumferential direction Dc.

The ring groove 44 includes a first groove portion 47 formed on the radial inner side Dri and open toward the radial inner side Dri, a second groove portion 48 formed on the radial outer side Dro of the first groove portion 47, and a stopper surface 46. The width dimension of the second groove portion 48 in the axial direction Da is wider than that of the first groove portion 47.

As illustrated in FIG. 3, the stopper surface 46 is a surface that is formed inside the ring groove 44 and faces the radial inner side Dri. The stopper surface 46 comes into contact with the radial positioning surface of the inside member 43 (will be described later) to restrict the displacement of the inside member 43 to the radial inner side Dri. The stopper surfaces 46 are respectively formed on the axial upstream side Dau and the axial downstream side Dad. These stopper surfaces 46 are formed between the first groove portion 47 and the second groove portion 48. The stopper surface 46 exemplified in the embodiment is inclined so as to be disposed on the radial outer side Dro as approaching the second groove portion 48 from the first groove portion 47, but the stopper surface 46 is not limited to this configuration.

The guide plate 42 is disposed on the axial downstream side Dad with respect to the flange 41. The guide plate 42 has an annular shape based on the axis Ar. The guide plate 42 includes an inner peripheral surface upstream side portion 51, an enlarged diameter portion 52, and a rib 53. The guide plate 42 can be formed of, for example, stainless (SUS) steel.

The inner peripheral surface upstream side portion is a part of an inner peripheral surface 42*a* of the guide plate 42, which is disposed on the axial upstream side Dau. The inner peripheral surface upstream side portion 51 is fixed to the flange 41 via a welded portion (refer to FIG. 3). The welded portion 54 may be formed by a combination of groove welding and fillet welding.

The inner peripheral surface upstream side portion 51 has a constant inner diameter at any position in the axial direction Da. In other words, an inner peripheral surface 51*a* of the inner peripheral surface upstream side portion 51 is formed in a cylindrical shape parallel to the axis Ar. In the embodiment, the length of the inner peripheral surface upstream side portion 51 in the axial direction Da is smaller than the thickness of the flange in the axial direction Da. The inner peripheral surface 51*a* of the guide plate 42 and the inner peripheral surface 45 of the flange 41 are arranged at the same position in the radial direction Dr. In other words, the inner peripheral surface 51*a* of the guide plate 42 and the inner peripheral surface 45 of the flange 41 are arranged flush with each other and are arranged so as to be continuous with each other along the axis Ar.

The enlarged diameter portion 52 is formed to be closer to the axial downstream side Dad than the inner peripheral surface upstream side portion 51. The inner diameter of the enlarged diameter portion 52 gradually increases about the axis Ar as going toward the axial downstream side Dad. The shape of the cross section of the guide plate 42 along the virtual plane including the axis Ar is formed in a curved shape that is convex toward the axis Ar side.

The rib 53 extends to the radial outer side Dro from the outer peripheral surface of the inner peripheral surface upstream side portion 51 and the enlarged diameter portion 52. The plurality of ribs 53 are provided at intervals in the circumferential direction Dc. The rib 53 is provided, for example, to improve the rigidity or strength of the inner peripheral surface upstream side portion 51 and the enlarged diameter portion 52.

The inside member 43 is attached so as to cover the inner peripheral surface 45 of the flange 41. The inside member 43 exemplified in the embodiment has a function of suppressing leakage of steam between the flange 41 and the last stage rotor blade row 13*a* in the radial direction Dr. As illustrated in FIG. 3, the inside member 43 includes a fitted section 61, a cover section 62, a fin 63, and an elastic body 64.

The fitted section 61 enters the ring groove 44 of the flange 41. The fitted section 61 is formed so as to protrude to the radial outer side Dro from the cover section 62. The fitted section 61 includes a first fitted section 66, a second fitted section 65, and a radial positioning surface 67.

The first fitted section 66 is disposed at the same position as the first groove portion 47 in the radial direction Dr. The length of the first fitted section 66 in the radial direction Dr is slightly longer than the length of the first groove portion 47 in the radial direction Dr. The width dimension of the first fitted section 66 in the axial direction Da is slightly narrower than the width dimension of the first groove portion 47 in the axial direction Da.

The second fitted section 65 is positioned on the radial outer side Dro of the first fitted section 66. The second fitted section 65 is disposed at the same position as the second groove portion 48 in the radial direction Dr. The length of the second fitted section 65 in the radial direction Dr is slightly shorter than the length of the second groove portion 48 in the radial direction Dr. The width dimension of the second fitted section 65 in the axial direction Da is slightly narrower than the width dimension of the second groove portion 48 in the axial direction Da. The width dimension of the second fitted section 65 is wider than the width dimension of the first fitted section 66. The second fitted section 65 is formed with a housing recessed portion 68 for housing and positioning the elastic body 64 on the surface that faces the radial outer side Dro.

The radial positioning surface 67 is formed between the first fitted section 66 and the second fitted section 65, and faces the radial inner side. The radial positioning surface 67 is an inclined surface that faces the stopper surface 46 of the ring groove 44 described above.

The cover section 62 faces the inner peripheral surface 45 of the flange 41 in the radial direction Dr. The cover section 62 covers at least parts of the inner peripheral surface 45 of the flange 41 and the inner peripheral surface 42*a* of the guide plate 42, which face a tip portion (rotor blade tip) 13*at* of the last stage rotor blade row 13*a* in the radial direction Dr. The cover section 62 in the embodiment faces a part on the axial upstream side Dau of the inner peripheral surface 51*a* of the inner peripheral surface upstream side portion 51 of the guide plate 42, in the radial direction Dr. In other words, the cover section 62 covers a part on the axial upstream side Dau of the inner peripheral surface upstream side portion 51 from the radial inner side Dri. Accordingly, the above-described welded portion 54 is also covered with the cover section 62 from the radial inner side Dri.

The cover section 62 has an inclined surface 69 at the end portion on the axial downstream side Dad of the inner peripheral surface that faces the radial inner side Dri. The inclined surface 69 is gradually inclined toward the radial outer side Dro as going toward the axial downstream side Dad. The inclined surface 69 reaches the downstream side end surface 70 which is the end surface on the axial downstream side Dad of the cover section 62. The inclined surface 69 includes an extension line TLE of a tangent line TL of a position of the most axial upstream side Dau on an inner peripheral surface 52*a* of the enlarged diameter portion 52 within the virtual plane (that is, the cross section along the virtual plane including the axis Ar) including the axis Ar illustrated in FIG. 3. More specifically, when the radial positioning surface 37 of the inside member 43 and the stopper surface 46 are in contact with each other, the inclined surface 69 includes the extension line TLE of the tangent line TL.

The cover section 62 is formed of a material having a higher erosion resistance with respect to steam and steam drain than that of the flange 41. In the embodiment, the entire inside member 43 is formed of the same material as that of the cover section 62. As a material having a higher erosion resistance with respect to steam and steam drain than that of the flange 41, for example, 12 chrome (Cr) steel can be used.

The fin 63 extends toward the radial inner side Dri from the cover section 62. The fin 63 is integrally formed with the cover section 62 by machining or the like, for example. The tip portion of the fin 63 is disposed with a slight gap such that the fin 63 and the last stage rotor blade row 13*a* do not come into contact with each other while suppressing the clearance flow with the tip portion 13*at* of the last stage rotor blade row 13*a* on the radial outer side Dro. Here, there is a case where the inside member 43 having the fin 63 is referred to as "seal ring". The fin 63 may be provided as necessary. For example, the fin 63 may be omitted in a case where the inside member 43 does not have the function of suppressing the leakage of steam between the flange 41 and the last stage rotor blade row 13*a* in the radial direction Dr.

The elastic bodies 64 are provided at two locations at an interval in the axial direction Da. The elastic bodies 64 constantly push the fitted section 61 to the radial inner side Dri. The elastic body 64 illustrated in FIG. 3 exemplifies a coil spring, but any elastic body such as a spring plate may be used as long as it is possible to press the fitted section 61 to the radial inner side Dri.

Figure 4:
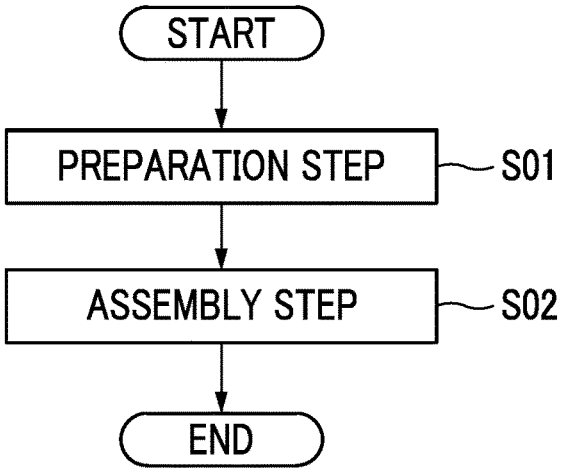
FIG. 4 is a flowchart of a method for manufacturing a flow guide according to the first embodiment of the invention.

FIG. 4 is a flowchart of a method for manufacturing a flow guide according to the first embodiment of the invention.

As illustrated in FIG. 4, in a case of manufacturing the above-described flow guide 27, a preparation step (step S01) and an assembly step (step S02) are performed.

In the preparation step, the flange 41, the guide plate 42, and the inside member 43 are prepared. In the embodiment, for example, the flange 41 is made of carbon steel, the guide plate 42 is formed of 12 chrome steel, and the inside member 43 is formed of stainless steel. Furthermore, in the preparation step, the flange 41 and the guide plate 42 are fixed by the welded portion 54. At this time, each of the flange 41, the guide plate 42, and the inside member 43 is not formed in an annular shape about the axis Ar.

In the assembly step, the fitted section 61 of the inside member 43 is put into the ring groove 44 of the flange 41. Specifically, the fitted section 61 of the inside member 43 is inserted into the ring groove 44 of the flange 41 together with the elastic body 64 in the circumferential direction Dc. After this, the assembly having the fitted section 61 inserted into the ring groove 44 is fixed to the inner casing 21 by the fasteners B such as bolts so as to be aligned in the circumferential direction Dc to form an annular shape.

In the above-described first embodiment, the cover section 62 of the inside member 43 is disposed so as to face the inner peripheral surface 45 of the flange 41 in the radial direction Dr, and covers at least the space from an edge 45*a* on the axial upstream side Dau to an edge 45*b* on the axial downstream side Dad on the inner peripheral surface 45 of the flange 41. The cover section is formed of a material having a higher erosion resistance than that of the flange 41. Therefore, while the fin 63 of the inside member 43 reduces the leakage of the flow that flows between the flange 41 and the tip portion 13*at* of the last stage rotor blade row 13*a*, and the cover section 62 of the inside member 43 can suppress the contact of the steam drain with the flange 41.

As a result, compared to a case where the flange 41 itself is formed of a material having a higher erosion resistance, while suppressing the manufacturing costs and the repair costs of the flow guide 27, it is possible to suppress the erosion of the flange 41 and lengthen the repair interval.

Furthermore, the cover section 62 can be installed so as to extend over the inner peripheral surface 45 of the flange 41 and the inner peripheral surface 42*a* of the guide plate 42. Therefore, erosion with the connecting part between the flange 41 and the guide plate 42 and with the inner peripheral surface upstream side portion 51 of the guide plate 42 can be respectively suppressed.

The welded portion 54 can be covered from the radial inner side by the cover section 62. Therefore, the erosion of the welded portion 54 can be suppressed.

Furthermore, the inclined surface 69 includes the extension line TLE of the tangent line TL within the virtual plane that includes the axis Ar at the position of the enlarged diameter portion 52 on the most axial upstream side Dau. Therefore, on the axial downstream side Dad of the last stage rotor blade row 13*a*, it is possible to suppress occurrence of delamination, and to smoothly recover the pressure of the main flow of the steam from an edge 69*a* of the inclined surface 69 on the axial upstream side Dau to the axial downstream side Dad.

In the above-described first embodiment, the elastic body 64 that pushes the inside member 43 to the radial inner side Dri is provided. Therefore, in a case where the tip portion 13*at* of the last stage rotor blade row 13*a* comes into contact with the fin 63, and the force by which the last stage rotor blade row 13*a* pushes the fin 63 becomes larger than the force by which the elastic body 64 pushes the inside member 43, it is possible to displace the inside member 43 to the radial outer side Dro.

Furthermore, the fitted section 61 of the inside member 43 has the radial positioning surface 67 that faces the radial inner side Dri, the ring groove 44 has the stopper surface 46 that faces the radial outer side Dro and is in contact with the radial positioning surface 67, and accordingly, it is possible to position the inside member 43 while allowing the inside member 43 to be displaced to the radial outer side Dro. Furthermore, when the radial positioning surface 67 and the stopper surface 46 are in contact with each other, the inclined surface 69 includes the extension line TLE of the tangent line TL of the guide plate 42 on the axial upstream side Dau, and accordingly, when the steam turbine ST is in the stable operation, it is possible to smoothly recover the pressure of the main flow of the steam toward the axial downstream side Dad from the edge 69*a* of the inclined surface 69 on the axial upstream side Dau.

Since the steam turbine ST includes the flow guide of the above-described first embodiment, the interval for repairing the flow guide 27 can be lengthened, and thus the burden on the operator who repairs the steam turbine ST can be reduced.

Furthermore, in a case of manufacturing the flow guide 27, the fitted section 61 of the inside member 43 only needs to be put into the ring groove 44 of the flange 41, and thus the flow guide 27 can be manufactured easily. Even when the erosion of the inside member 43 progresses and the inside member 43 is replaced, the inside member 43 can be attached to the flange 41 by simply preparing the inside member 43 and putting the fitted section 61 into the ring groove 44 of the flange 41.

Second Embodiment

Next, a second embodiment of the present invention will be described with reference to the drawings. The second embodiment differs from the above-described first embodiment only in the inside member. Therefore, the same parts as those in the first embodiment will be given the same reference numerals, and the duplicate description will be omitted.

Figure 5:
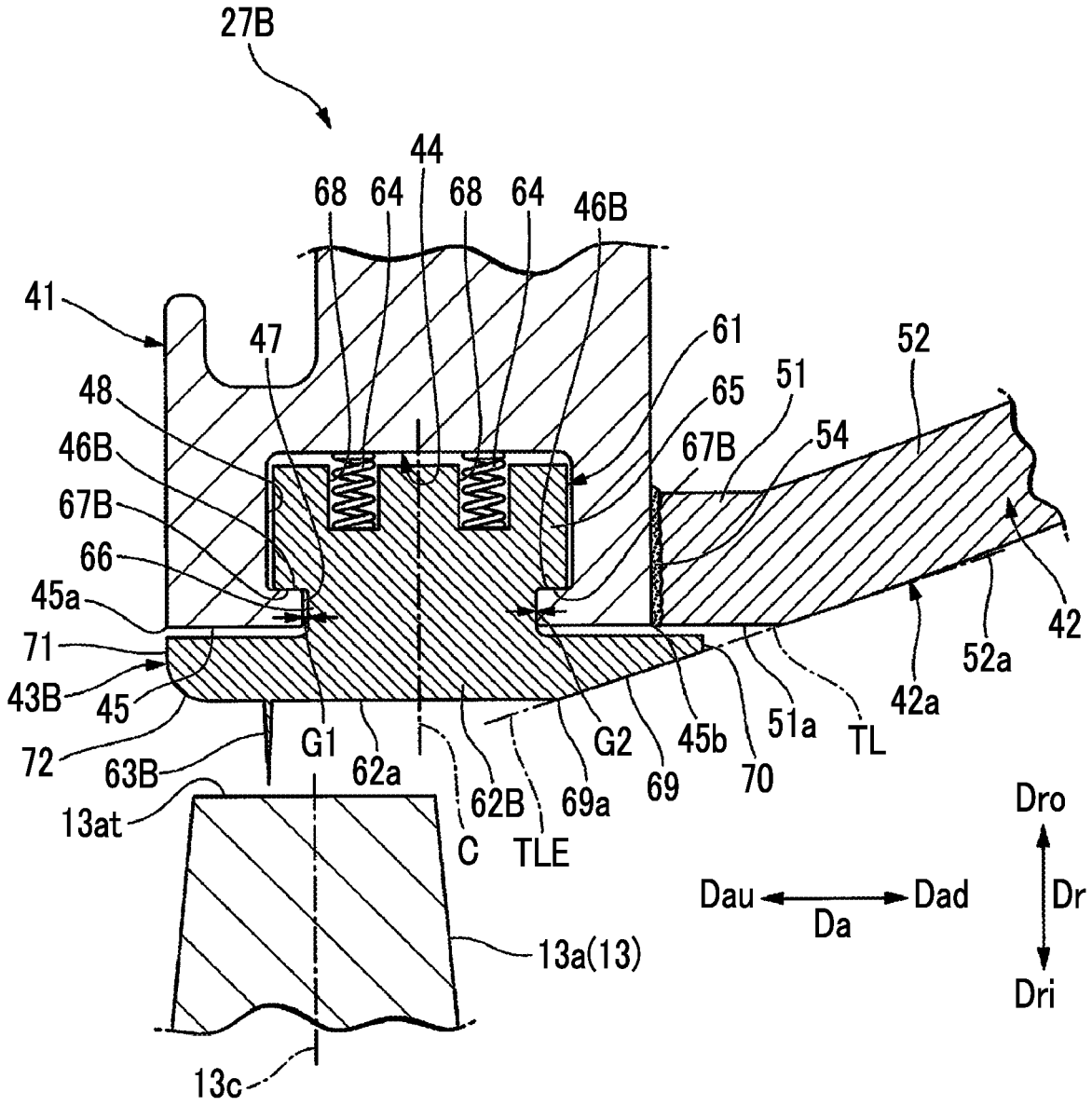
FIG. 5 is a sectional view corresponding to FIG. 3 in a second embodiment of the invention.

FIG. 5 is a sectional view corresponding to FIG. 3 in the second embodiment of the invention.

As illustrated in FIG. 5, a flow guide 27B of the second embodiment includes the flange 41, the guide plate 42, and an inside member 43B.

A ring groove 44 is formed in the flange 41.

The ring groove 44 includes the first groove portion 47, the second groove portion 48, and a stopper surface 46B.

The stopper surface 46B is a surface that is formed inside the ring groove 44 and faces the radial inner side Dri. Since the stopper surface 46B comes into contact with a radial positioning surface 67B of the inside member 43B, the displacement of the inside member 43B to the radial inner side Dri is restricted. The stopper surfaces 46B are formed on the axial upstream side Dau and the axial downstream side Dad, respectively. The stopper surfaces 46B are formed between the first groove portion 47 and the second groove portion 48. The stopper surface 46B exemplified in the second embodiment extends in the axial direction Da.

The inside member 43B is attached so as to cover the inner peripheral surface 45 of the flange 41. Similar to the inside member 43 of the first embodiment, the inside member 43B has a function of suppressing the leakage of steam between the flange 41 and the last stage rotor blade row 13*a* in the radial direction Dr.

The inside member 43B includes the fitted section 61, a cover section 62B, a fin 63B, and the elastic body 64.

The fitted section 61 has the same configuration as that of the first embodiment and enters the ring groove 44 of the flange 41. The fitted section 61 is formed so as to protrude to the radial outer side Dro from the cover section 62B. The fitted section 61 includes the first fitted section 66, the second fitted section 65, and the radial positioning surface 67B.

Of the gaps formed between the first fitted section 66 and the ring groove 44, the size of a gap G2 formed on the axial downstream side Dad is narrower than the size of a gap G1 formed on the axial upstream side Dau. The second embodiment exemplifies a case where the size of the gap G2 formed on the axial downstream side Dad is zero.

The cover section 62B faces the inner peripheral surface 45 of the flange 41 in the radial direction Dr. The cover section 62B covers at least parts of the inner peripheral surface 45 of the flange 41 and the inner peripheral surface 42*a* of the guide plate 42, which face the tip portion (rotor blade tip) 13*at* of the last stage rotor blade row 13*a* in the radial direction Dr.

The cover section 62B in the second embodiment faces a part of the inner peripheral surface 51*a* of the guide plate 42 on the axial upstream side Dau of the inner peripheral surface upstream side portion 51 in the radial direction Dr. In other words, the cover section 62B covers a part of the inner peripheral surface upstream side portion 51 on the axial upstream side Dau from the radial inner side Dri. Accordingly, the above-described welded portion 54 is also covered from the radial inner side Dri with the cover section 62B.

The cover section 62B has the inclined surface 69 at the end portion on the axial downstream side Dad of an inner peripheral surface 62*a* that faces the radial inner side Dri. The inclined surface 69 is gradually inclined toward the radial outer side Dro as going toward the axial downstream side Dad. The inclined surface 69 reaches the downstream side end surface 70 which is the end surface of the cover section 62B on the axial downstream side Dad. The inclined surface 69 includes the extension line TLE of the tangent line TL at a position of the inner peripheral surface 52*a* of the enlarged diameter portion 52 on the most axial upstream side Dau within the virtual plane (that is, the cross section along the virtual plane including the axis Ar) including the axis Ar illustrated in FIG. 5.

The cover section 62B has a curved surface 72 between the inner peripheral surface 62*a* and an end surface 71 on the axial upstream side Dau of the cover section 62B in the axial direction Da. More specifically, between the end surface 71 and a part that extends in the axial direction Da on the axial upstream side Dau from the inclined surface 69 on the inner peripheral surface 62*a*, the curved surface 72 formed in a convex shape toward the outside is provided. The curved surface 72 may have a constant radius of curvature, or may be formed by combining a plurality of curved surfaces having different radii of curvature.

The cover section 62B is formed of a material having a higher erosion resistance with respect to steam and steam drain than that of the flange 41. Similar to the first embodiment, in a case where the flange 41 is a metal material such as carbon steel, for example, 12 chrome (Cr) steel can be used as the material having a higher erosion resistance with respect to steam and steam drain than that of the flange 41.

The fin 63B extends from the cover section 62B toward the radial inner side Dri. The fin 63B is integrally formed with the cover section 62B by machining or the like. In other words, the fin 63B and the cover section 62B are formed of the same metal material and are continuous with each other without having a joint surface.

The tip portion of the fin 63B is disposed with a slight gap such that the fin 63B and the last stage rotor blade row 13*a* do not come into contact with each other while suppressing the clearance flow with the tip portion 13*at* of the last stage rotor blade row 13*a* on the radial outer side Dro.

The fin 63B is disposed to be closer to the axial upstream side Dau than the center position C between the end surface 71 of the cover section 62B on the axial upstream side Dau and the end surface 70 of the cover section 62B on the axial downstream side Dad in the axial direction Da. In the fin 63B of the second embodiment, a case where the fin 63B is disposed to be closer to the axial upstream side Dau than a center position 13*c* of the tip portion 13*at* of the last stage rotor blade row 13*a* in the axial direction Da is further exemplified.

The invention is not limited to each of the above-described embodiments, and various modifications are included in the above-described embodiments without departing from the spirit of the invention. In other words, the specific shapes or configurations described in the embodiments are merely examples, and can be changed appropriately.

The steam turbines of the above-described embodiments are all of the downward exhaust type, but may be of the side exhaust type.

The steam turbines of the above-described embodiments are all of the two-split exhaust type, but the present invention may be applied to a steam turbine that does not split the exhaust.

INDUSTRIAL APPLICABILITY

According to the flow guide, the steam turbine, the inside member, and the method of forming a flow guide, it is possible to lengthen the repair interval while suppressing the manufacturing costs and the repair costs.

REFERENCE SIGNS LIST

10*a* first steam turbine section
10*b* second steam turbine section
11 turbine rotor (steam turbine rotor)
12 rotor shaft
12*a* outer peripheral surface
13 rotor blade row
13*a* last stage rotor blade row
13*at* tip portion (rotor blade tip)
17 stator blade row
18 bearing
19 steam inlet duct
20 casing
21 inner casing
210 outer peripheral surface
21*s* first space
25 exhaust casing
26 diffuser
26*s* diffuser space
27 flow guide
29 bearing cone
29*a* end edge
30 outer casing
30*s* second space
31 exhaust port
32 downstream end plate
34 upstream end plate
36 side peripheral plate
37 surface
41 flange
41*h* through-hole
42 guide plate
42*a* inner peripheral surface
43, 43B inside member
44 ring groove
45 inner peripheral surface
45*a* edge
45*b* edge
46, 46B stopper surface
47 first groove portion
48 second groove portion
51 inner peripheral surface upstream side portion
51*a* inner peripheral surface
52 enlarged diameter portion
52*a* inner peripheral surface
53 rib
54 welded portion
61 fitted section
62, 62B cover section
63, 63B fin
64 elastic body
65 second fitted section
66 first fitted section
67, 67B radial positioning surface
68 housing recessed portion
69 inclined surface
69*a* edge
70 downstream side end surface

The invention claimed is:

1. A flow guide comprising:

a flange disposed on a radial outer side based on an axis with respect to a last stage rotor blade row of a steam turbine rotor that rotates about the axis;

a guide plate that forms an annular shape based on the axis, gradually widens to the radial outer side as going toward an axial downstream side which is a first side in an axial direction in which the axis extends, and is disposed on the axial downstream side which is the first side in the axial direction in which the axis extends, with respect to the flange; and an inside member attached so as to cover an inner peripheral surface of the flange, wherein a ring groove, which is recessed to the radial outer side from the inner peripheral surface of the flange and extends in a circumferential direction based on the axis is formed in the flange, wherein the inside member includes a fitted section which enters the ring groove, and a cover section which faces the inner peripheral surface of the flange in a radial direction, and wherein the cover section covers at least parts of the inner peripheral surface of the flange and an inner peripheral surface of the guide plate, which face a rotor blade tip of the last stage rotor blade row in the radial direction, and is formed of a material having a higher erosion resistance than that of the flange with respect to steam and steam drain.

2. The flow guide according to claim 1, wherein the cover section faces an inner peripheral surface upstream side portion which is a part on an axial upstream side of the inner peripheral surface on the guide plate in the radial direction, and also covers the inner peripheral surface upstream side portion.

3. The flow guide according to claim 2, further comprising:

a welded portion that joins the flange and the guide plate.

4. The flow guide according to claim 2, wherein the guide plate has an enlarged diameter portion of which an inner diameter gradually increases as going toward the axial downstream side, on the axial downstream side of the inner peripheral surface upstream side portion, wherein the inner peripheral surface upstream side portion of the guide plate has a constant inner diameter at any position in the axial direction, wherein the cover section has an inclined surface that gradually extends to the radial outer side as going toward the axial downstream side, wherein the fitted section has a radial positioning surface that faces a radial inner side, wherein the ring groove has a stopper surface that faces the radial outer side and is in contact with the radial positioning surface, and wherein the inclined surface extends to a downstream side end surface which is an end surface of the cover section on the axial downstream side when the radial positioning surface and the stopper surface are in contact with each other, the inclined surface includes an extension line of a tangent line of the enlarged diameter portion.

5. The flow guide according to claim 4, further comprising:

an elastic body that is disposed in the ring groove and pushes the inside member to the radial inner side.

6. The flow guide according to claim 1, wherein the inside member includes a fin that extends toward the radial inner side from an inner peripheral surface of the cover section that faces the rotor blade tip.

7. A steam turbine comprising:

the flow guide according to claim 1;

the steam turbine rotor; and a casing which has a cylindrical shape about the axis, in which the steam turbine rotor is disposed on a radial inner side, and to which the flow guide is attached.

8. A method for manufacturing a flow guide according to claim 1, comprising:

a preparation step of preparing the flange, the guide plate, and the inside member; and an assembly step of putting the fitted section of the inside member into the ring groove of the flange.

9. The flow guide according to claim 6, wherein the fin is disposed to be closer to the axial upstream side than a center position in an axial direction between an end surface on the axial upstream side of the cover section and an end surface on the axial downstream side of the cover section.

10. The flow guide according to claim 6, wherein the fin extends toward a radial inner side from the cover section and is integrally formed with the cover section.

11. An inside member which is attached so as to cover an inner peripheral surface of a flange disposed on a radial outer side based on an axis with respect to a last stage rotor blade row of a steam turbine rotor that rotates about the axis, the inside member comprising:

a fitted section that enters a ring groove of the flange;

a cover section that faces the inner peripheral surface of the flange in a radial direction; and a fin that extends toward an inner side in the radial direction from an inner peripheral surface of the cover section facing a rotor blade tip of the last stage rotor blade row, on the inner peripheral surface of the cover section, wherein the cover section is formed so as to cover at least parts of the inner peripheral surface of the flange and an inner peripheral surface of a guide plate disposed on an axial downstream side with respect to the flange, which face the rotor blade tip of the last stage rotor blade row in the radial direction, and wherein the cover section faces an inner peripheral surface upstream side portion which is a part on an axial upstream side of the inner peripheral surface on the guide plate in the radial direction, and also covers the inner peripheral surface upstream side portion.

12. The inside member according to claim 11, wherein the cover section has an inclined surface that gradually extends to the radial outer side as going toward the axial downstream side.

13. The flow guide according to claim 11, wherein the fin extends toward a radial inner side from the cover section and is integrally formed with the cover section.

14. The inside member according to claim 11, wherein the cover section is formed of a material having a higher erosion resistance than that of the flange with respect to steam and steam drain.

* * * * *